United States Patent [19]

Kichline

[11] Patent Number: 4,862,148

[45] Date of Patent: Aug. 29, 1989

[54] PORTABLE ELECTRIC SMOKE DETECTOR/ALARM FLASHLIGHT

[76] Inventor: Timothy J. Kichline, 811 Center St., Bethlehem, Pa. 18018

[21] Appl. No.: 112,940

[22] Filed: Oct. 13, 1987

[51] Int. Cl.[4] ..... G08B 17/10

[52] U.S. Cl. ..... 340/628; 362/457

[58] Field of Search ..... 340/628, 629, 630; 362/157, 171, 178, 457, 458; 250/573–577; D26/38

[56] References Cited

U.S. PATENT DOCUMENTS

| | | | |
|---|---|---|---|
| 3,950,739 | 4/1976 | Campman | 340/628 |
| 4,438,428 | 3/1984 | Ober et al. | 340/630 |
| 4,617,561 | 10/1986 | Brown | 340/630 |

*Primary Examiner*—Joseph A. Orsino
*Assistant Examiner*—Jill D. Jackson

[57] ABSTRACT

A portable electric personal safety device including a tri-sectional elongated hollow tube; electric light source; smoke detection, alarm and electric light circuit means within the tube; a smoke detection and alarm system mounted in the one end section of the tri-sectional elongated hollow tube; an electric light system and transparent covering mounted in the other end section of the tri-sectional elongated hollow tube; the electric light system being driven by the electric light circuit means and battery source mounted within the central section of the tri-sectional elongated hollow tube assembly; the electric light power supply therefore being interposed between the smoke detector/alarm assembly and the electric light assembly; one low voltage small light is situated in the center of the end wall of the smoke detector/alarm housing comprised of the one end section of the tri-sectional elongated hollow tube; one push switch mounted on the outer wall of the one end section of the tri-sectional elongated hollow tube comprising the smoke detector/alarm housing connected with the smoke detector/alarm circuit means for independently activating the smoke detector/alarm system; one push switch mounted on the outer wall of the center section of the tri-sectional elongated tube which comprises the battery power source housing for independently activating the electric light; two threaded screw cap closure means for connecting the three sections of the elongated hollow tube permitting the connection of all three tubular sections thereby integrating the component parts of the invention into a functioning unit.

7 Claims, 1 Drawing Sheet

PORTABLE ELECTRIC SMOKE DETECTOR/ALARM FLASHLIGHT

FIELD INVENTION

Figure 1:
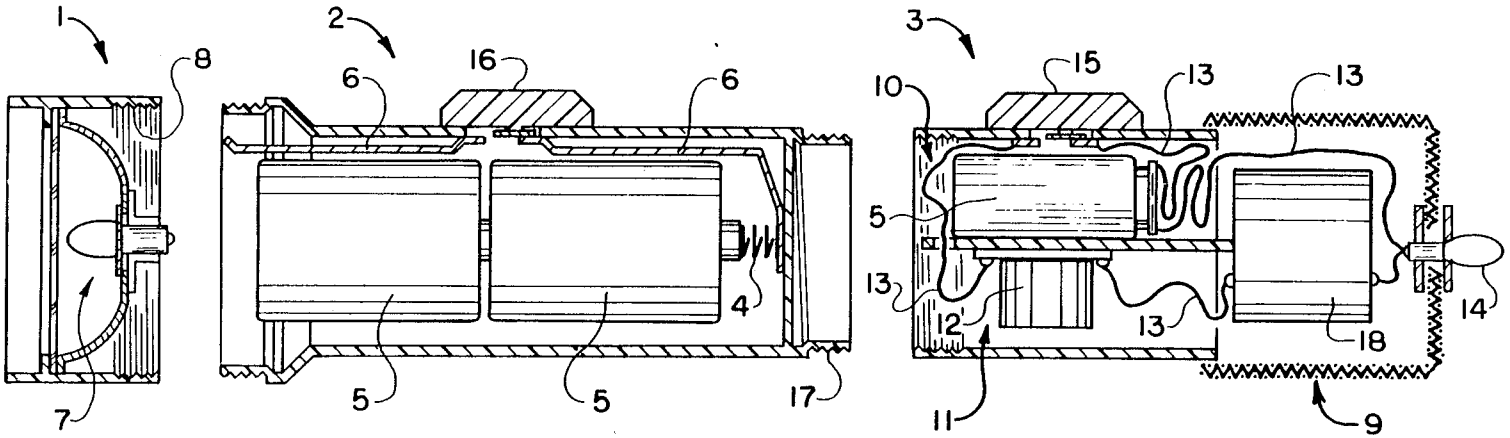
Figure 2:
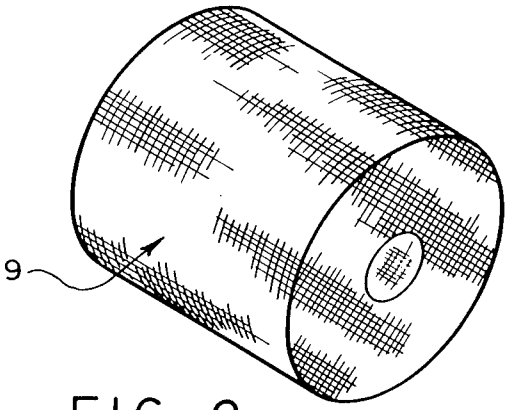

This invention relates to smoke detection and alarm systems and more particularly concerns portable personal safety smoke detection and alarm systems.

BACKGROUND OF THE INVENTION

Conventional smoke detection/alarm systems are stationary, usually permanently attached to the surface of some structure. They provide adequate detection and warning functions for the immediate vicinity of the surface on which they are attached. By their nature, these devices must more or less always be attached to some surface preventing easy movement to temporary localities where an individual may desire and/or need such a warning device.

Fire and smoke hazards exist in many places and situations outside the home or work place where permanently mounted smoke detection and alarm systems are normally found. Furthermore, there are many areas of the world which do not have the same building codes and safety ethic present in the U.S. and similarly industrialized nations. This personal safety device would permit the traveler an opportunity to transport a measure of protection in the form of smoke detection and warning.

Therefore, in the event of a catastrophe such as a hotel fire (a very common occurrence in certain parts of the world) accompanied by a probable loss of power the device being battery powered would still be functional and be able to warn an individual of danger. The low voltage location light (in conjunction with or without the alarm sound itself) permits an individual to find the device in the dark. Once located, the electric light may be activated to aid the individual.

Furthermore the device in combination with a mounting bracket (or other similar stand designed to hold the device), the device may be mounted anywhere and still retain its characteristics of portability. For instance (but not exclusive of other locations) the device may be mounted in any form of transportation, be it airplane, boat, automobile, etc. This would permit the device to be used interchangeably between locations.

SUMMARY OF INVENTION

It is therefore an object of this invention to provide an improved, easily portable and operated electric fire detection and warning system combined with a reliable, portable, electric light source which is lightweight and compact.

It is a further object of this invention to provide such a personal safety device which utilizes standard components and is readily manufacturable.

The invention features a portable combination of an electronic fire detection and alarm system with an electric light source housed within and supported by a tri-sectional elongated hollow tube. There is electronic circuitry within the tube for independently engaging either or both the smoke detector/alarm system and the electric light. Two independent power supplies are housed within specific sections of the tri-sectional tube situated between and supporting the two primary active functioning systems of the device. Two switches independently engage the two primary active systems of the device.

In a preferred embodiment of this device the smoke detection/alarm system may include a circuit board, a smoke alarm component apparent to one skilled in the art comprised of, smoke sensor, alarm device, and battery housed within the elongated trisectional hollow tube comprising the smoke detector/alarm chamber. A light bulb and reflector for projecting the light are found mounted within another section of the tube comprising the flashlight chamber. The remaining section of the tri-sectional tube being a battery chamber which is in support of the flashlight chamber.

DISCLOSURE OF PREFERRED EMBODIMENT

Other objects, features and advantages will occur from the following description of a preferred embodiment and accompanying drawings in which:

FIG. 1 is a cross sectional frontal elongational view of the device according to the invention.

The device according to this invention may be achieved by the use of a tri-sectional elongated hollow tube approximately twelve inches in length and varying widths of each chamber to be subsequently specified by way of example but may be of other dimensions to enlarge or diminish the overall size of the device.

The power source section for the electric light being approximately 1½ inches in diameter. The flashlight assembly and smoke detection and alarm sections are approximately 2½ inches in diameter.

The tri-sectional hollow tube are made of a durable material. Durable material such as (but not exclusive of other suitable materials apparent to one skilled in the art) aluminum, plastic or steel.

A conventional flashlight assembly 7 is mounted in tubular section 1 of FIG. 1 of the drawing of this invention. A conventional flashlight circuit which actuates the flashlight and battery assembly are mounted within tubular section 2. An on/off switch 16 is mounted on the outside wall of tubular section 2 which when engaged completes the electric circuit which actuates the flashlight thereby activating the electric light. A spring assembly 4 which forms part of the electric circuit which actuates the flashlight reposes and is attached to the inside of the closed end of the battery chamber of tubular section 2. Said spring maintains the electric batteries in a secure position ensuring completion of the flashlight circuitry 6 with the battery power source 5 to in turn power the flashlight assembly in tubular section 1.

The light bulb reflector and transparent lens parts of the conventional flashlight assembly 7 in FIG. 1 in combination are of a larger diameter than the battery section 2 of the tri-sectional hollow tube. This assembly therefore forms a stable base which permits the entire device to stand erect on any level or reasonably level surface, thereby extending the smoke detection alarm assembly contained in section 3 into a vertical position where it may perform its function of sampling the atmosphere for smoke. In the event smoke is detected, the smoke alarm component is activated.

The flashlight lens assembly of tubular section 1 is connected to the battery circuitry chamber of tubular section 2 by means of a threaded screw end 8 whereby the tubular sections 1 and 2 of the tri-sectional hollow tube are joined together to both complete the electric circuit which actuates the flashlight to power the flashlight assembly but also to permit access to both chambers to maintenance the power source and the light source.

The third section of the elongated hollow tube 3 forms the smoke detection/alarm device housing. This section comprising the housing is tri-chambered (chambers being noted as sections 9, 10 and 11 in FIG. 1) each chamber housing a separate component which in combination form the smoke detection/alarm device of the invention. Each chambered component is integrated within the circuit which actuates the smoke detection means, thereby composing and completing the warning system.

Chamber 10 of tubular section 3 contains the battery power source. Chamber 10 is separated by a panel of durable material from chamber 11 which contains and supports the smoke detection/alarm circuit board 12.

The circuit board between chambers 10 and 11 is mounted on and fastened to the panel of durable material separating the battery chamber 10 from the alarm chamber 11.

The third chamber within the tubular section 3 housing the smoke detection/alarm devices reposes above chambers 10 and 11. The outside walls of this portion of the tubular section 3 are vented or screened along both the sides and the closed end surrounding the location light 14 opposite the threaded screw closure 17 which connects tubular sections 3 and 2 in order to facilitate the free flow of air into the chamber to permit the smoke sensing device housed therein to perform its function.

Circuitry 13 which actuates the smoke detection means connects the smoke detector 18 with the battery source in chamber 10 and in turn this circuit which actuates the smoke detection means connects with the alarm device in chamber 11.

Located in the center of the outside wall of the closed end of the tubular section 3 is situated a low voltage light 14 integrated into the same circuitry which actuates the smoke detection means 13 which connects the power source in chamber 10 with the detection and alarm devices within chambers 9 and 11. The low voltage light is also actuated by the smoke detector which connects it to the power supply. The light is so situated in order to aid in the location of the entire device by an individual skilled in the art in circumstances of low or no visibility.

An on/off switch noted as item 15 for activating the smoke detector/alarm assembly is located on the outer wall of tubular section 3. When engaged it activates the smoke detector/means.

Other embodiments will occur to those skilled in the art and are within the following claims.

What is claimed is:

1. A portable flashlight and smoke alarm device comprising:

an elongated tube comprised of first end, center, and second end chambers where the first end chamber contains a conventional flashlight assembly;

the center chamber contains: a first power supply and flashlight circuit means with a first push button switch connecting the flashlight circuit means to the first power supply, the second end chamber being partially vented and containing a second power supply and smoke detection means including a smoke detector and alarm and where a second push button switch connects the smoke detection means with the second power supply.

2. The device of claim 1 in which the first and second end chambers and the center chamber of the tube include threaded screw-ends for engaging the two end chambers to the center chamber to form a single functioning entity.

3. The device of claim 1 in which the first power supply is contained within a battery holder in the center chamber.

4. The device of claim 1 where the conventional flashlight assembly in the first end chamber includes a light bulb, reflector chamber, and transparent end covering.

5. The device of claim 1 in which the smoke detection means includes a circuit board.

6. The device of claim 1 where the circuit board is fastened to a panel of durable material located in the second end chamber of the tube.

7. The device of claim 1 in which a low voltage light is located on an outside wall of the second end chamber and is actuated in response to the smoke detector sensing smoke.

* * * * *